United States Patent [19]

Dasher et al.

[11] 4,129,505

[45] Dec. 12, 1978

[54] ANTI-STATIC SPRAY AND METHOD OF USE

[75] Inventors: George F. Dasher, Inverness; August E. Fiebig, Jr., Chicago, both of Ill.

[73] Assignee: Alberto-Culver Company, Melrose Park, Ill.

[21] Appl. No.: 883,723

[22] Filed: Mar. 6, 1978

Related U.S. Application Data

[63] Continuation-in-part of Ser. No. 725,361, Sep. 22, 1976, abandoned.

[51] Int. Cl.[2] ..... D06M 13/46

[52] U.S. Cl. ..... 252/8.8; 428/279; 252/8.6

[58] Field of Search ..... 252/8.8, 8.6; 428/279

[56] References Cited

U.S. PATENT DOCUMENTS

| | | | |
|---|---|---|---|
| 3,382,096 | 5/1968 | Boardman | 428/279 |
| 3,395,100 | 7/1968 | Fisher et al. | 252/8.8 R |
| 3,515,580 | 6/1970 | Eastes | 252/8.6 |
| 3,630,949 | 12/1971 | Brux et al. | 252/8.8 |
| 3,914,496 | 10/1975 | Sorek et al. | 428/279 |
| 3,958,059 | 5/1976 | Diehl | 252/8.8 |

FOREIGN PATENT DOCUMENTS

| | | | |
|---|---|---|---|
| 571219 | 2/1959 | Canada | 428/279 |

*Primary Examiner*—William E. Schulz

*Attorney, Agent, or Firm*—Tilton, Fallon, Lungmus & Chestnut

[57] ABSTRACT

An anti-static spray comprising an ethanol solution of quaternary ammonium fabric softener in combination with ammonium acetate. The spray is particularly adapted for application to clothing otherwise ready to wear.

7 Claims, No Drawings

ANTI-STATIC SPRAY AND METHOD OF USE

CROSS-REFERENCE

This application is a continuation-in-part of copending application Ser. No. 725,361, filed Sept. 22, 1976, for Anti-Static Spray and Method of use now abandoned.

BACKGROUND OF THE INVENTION

It is known that quaternary ammonium fabric softeners when applied to fabrics also function to some extent as anti-static agents. More specifically, under some conditions of temperature and humidity, fabrics which have been coated with a quaternary ammonium softener are more resistant to the accumulation of static electricity. Fabric softeners having anti-static properties have been applied to clothing in a final rinse solution during washing, or are applied to the clothing in a clothes dryer, either as a spray or on a carrier paper. The effectiveness of such treatments in preventing clothing from developing static cling is limited. Static electric charges may develop somewhat more slowly, but once present on the fabric, they tend to remain and are not readily dissipated. This problem is particularly severe when the relative humidity is low.

U.S. Pat. No. 3,630,949 discloses an aerosol spray composition for applying an anti-static coating on surfaces. The coating is said to be in the form of a thin conductive film of a waxy consistency to bleed off or dissipate static charges on said surfaces. The active ingredient is dimethyl dihydrogenated tallow ammonium chloride or dimethyl distearyl ammonium chloride, which is said to provide slight electrical conductivity to bleed off or dissipate electrostatic charges generated on the surfaces. The quaternary ammonium compound is applied in a solvent system consisting of anhydrous ethyl alcohol and methylene chloride.

U.S. Pat. Nos. 3,958,059 and 3,959,155 describe anti-static and fabric softening compositions composed of quaternary compounds in solid form with electrically conductive salts dispersed therein. Lithium or aluminum salts of inorganic or organic acids are preferred. For use, stable dispersions are formed in water. If the water contains an alcohol, the amount is limited to preclude solubilization of the anti-static fabric softening compositon. Typically, the liquid dispersions are used in rinse water as part of a laundering operation.

Heretofore, as far as applicants are aware, there have been no effective spray-type preparations which could be applied by the wearer of the clothing subject to static electric build-up. What has been needed is a preparation which could be sprayed on the clothing by the wearer of the clothing either immediately prior to wearing the garment, or even while wearing the clothing. This need was not satisfactorily met until the development of the present invention.

BRIEF SUMMARY OF THE INVENTION

The anti-static spray of this invention comprises a volatile ethanol solvent carrier containing hygroscopic ammonium acetate in combination with a quaternary ammonium fabric softener. For accomplishing the purposes of this invention, the specific salt ($NH_4OAc$), the limitation of the amount of water in the ethanol solvent, and the concentrations and relative amounts of the fabric softener and the ammonium acetate are important.

The quaternary ammonium fabric solfetner and the ammonium acetate cooperate in controlling and substantially preventing the accumulation of static electric charges on fabric, such as the fabric of clothing. It is believed that one action of the fabric softener is to impart lubricity to the fibers of the fabric, thereby tending to reduce frictional build-up of static electric charges on the fabric. The quaternary ammonium softener being in salt form, also is ionic in aqueous solution and thereby conductive. However, the degree of conductivity is relatively low when the softener is present on the fabric. Moreover, it becomes less effective as the ambient atmosphere becomes drier. However, the ammonium acetate compensates and supplements the anti-static action of the softener. In particular, it is believed that the ammonium acetate imparts much greater conductivity to the fabric, which assists in the dissipation of static electric charges. This action is believed to be promoted by the fact that ammonium acetate is hygroscopic and deliquescent. Sufficient moisture is thereby retained from the carrier or absorbed from the atmosphere to maintain the ionic character of the salt, and this moisture also assits in maintaining the ionic character of the fabric softener. These modes of action are not known with certainty, but it is known that the quaternary softener and the ammonium acetate cooperate to effectively control the development of static electric charges on clothing, or other fibrous materials such as drapes, carpeting, human hair, pet hair, etc.

Since the spary is highly volatile, it can be applied without unduly wetting the fabric. This is important when the spray is used on clothing immediately prior to or during wearing of the clothing. The anti-static spray of this invention thereby makes possible a new method of use in which clothing are treated to prevent static electricity from accumulating thereon at a time when the clothing are otherwise ready to wear.

DETAILED DESCRIPTION OF THE INVENTION

The solvent used in preparing the anti-static spray of this invention is ethanol containing a limited amount of water. For example, aqueous ethanol containing from 2 to 10% by weight water (90 to 98% ethanol) can be used. The presence of a limited amount of water is important. The ethanol should not contain over 10% water. One usuable solvent carrier contains from 4 to 8% water (92 to 96% ethanol). Both the quaternary and the ammonium acetate are soluble in the carrier. In accordance with alcohol control laws and regulations, the ethanol will be employed in denatured form. Acceptable denaturing agents include brucine sulfate and tertiary butyl alcohol. However, other denaturants can be used.

The minimum amount of water which has been found effective is approximately 0.1% by weight of the total formulation (ethanol, ammonium acetate, and quaternary ammonium fabric softener). Anhydrous ethanol can therefore be used as solvent, providing a small amount of water is added to the formulation. This water can be added with the ammonium acetate (as water of hydration), or with the quaternary ammonium fabric softener. Even though the amount of water present is small on initial application, the hygroscopic ammonium acetate will continue to function as an ionic static dissipating agent, compensting for the tendency of the quaternary ammonium compound to become less effective as the atmosphere becomes drier.

As indicated above, one of the cooperating anti-static agents is a quaternary ammonium fabric softener. As is well-known in the fabric softening art, quaternary ammonium fabric softeners perferably contain two long chain aliphatic groups (e.g. alkyl or alkylene), such as hydrocarbon groups of from 12 to 22 carbon atoms, and necessarily contain at least one of such long chain aliphatic groups. For the purpose of the present invention, any quaternary ammonium fabric softener compound can be used. This includes the well-recognized classes of such fabric softeners and the specific softeners listed in U.S. Pat. Nos. 3,686,025 and 3,904,359. The disclosure of these patents with respect to the general classes and specific fabric softener compounds is incorporated by reference. One preferred class of such softeners is the dialkyl dimethyl ammonium salts where the alkyl groups contain from 12 to 22 carbon atoms. The chloride salt is the most commonly employed, but other salt forms can be used. such as sulfate, acetate, nitrate or phosphate. The same salt forms can also be used for other classes of quaternary ammonium fabric softener compounds. These classes include quaternary imidazolinium compounds, Zwitterionic quaternary ammonium compounds, all being in salt form as stated. A typical fabric softener which can be advantageously employed in the present invention is ditallow dimethyl ammonium chloride. The term "tallow" refers to the fact that the long chain aliphatic groups are those derived from tallow, being composed principally of hydrocarbon groups containing from 16 to 18 carbon atoms. As indicated, for the purpose of the present invention it is preferred that the quaternary ammonium fabric softener contain two aliphatic groups, such as hydrocarbon groups, containing from 12 to 22 carbon atoms.

The quaternary ammonium fabric softeners are soluble in the aqueous ethanol carrier. They are employed as a dilute solution, such as a concentration of from 0.5 to 2.0% by weight of the quaternary ammonium salt based on the solvent carrier. A particularly advantageous concentration is in the range from 0.7 to 1.5% on the same basis.

The improvement of the present invention is obtained by employing in combination with the quaternary ammonium fabric softener the specific compound, ammonium acetate. Further, to obtain a marked improvement of the anti-static properties of the quaternary ammonium fabric softeners, the specified ammonium acetate must be used in certain relative proportions. In general, the desirable range is from 0.05 to 0.5 parts by weight of the ammonium acetate per each part by weight of the quaternary ammonium salt. Within this range, the two anti-static agents appear to act synergistically. The combined results with respect to the prevention of the accumulation of static electric charges on clothing or other fabrics is greater than that which would be anticipated from using either agent alone. Apparently the modes of action of the two different kinds of anti-static agents cooperate, or supplement each other, so as to produce a greatly improved result. When the two anti-static agents are employed in the proper relative proportions, fabric cling and other undesirable results of the build-up of static electric charges on clothing can be prevented even under very dry atmospheric conditions.

In preferred formulations, from 0.1 to 0.3 parts by weight of the ammonium acetate are employed per part by weight of a quarternary ammonium salt (fabric softener). Other common ammonium salts such as the chloride and sulfate, are less effective for the purpose of the present invention, and also have the disadvantage of being incompatible with brucine sulfate, causing a precipitate to form from the denatured ethanol.

By limiting the amount of water present in the solvent to less than 10% and preferably to less than 8%, the aqueous ethanol is highly volatile. When sprayed onto clothing, fabric, or other fibrous material, it evaporates rapidly. A coating of the combined quaternary ammonium salt and the ammonium acetate is left on the fabric. Because of the hygroscopic properties of the ammonium acetate, a small amount of water will be retained in the coating, so that the coating is ionic and conductive to static electric charges. Because of the hygroscopic and deliquescent nature of the ammonium acetate additional moisture can be absorbed from the atmosphere. This is particularly important where the coating is dried to such a low moisture content that its conductivity is reduced.

The fabric spray can be applied with a conventional pumper-sprayer bottle. Even if the droplets of the spray are relatively coarse, the high volatility of the carrier will prevent the clothing or fabric from being unduly wetted with the spray. If desired, however, other methods of delivering the spray can be employed, such as an aerosol propellant system, using an aerosol container equipped with a spray nozzle and manually-operable valve. The propellant used for the aerosol spray can be any of the conventional aerosol propellants. Perferable, a highly volatile propellant is employed so that very little if any propellant is delivered to the clothing or fabric in liquid form. Carbon dioxide is a particularly suitable propellant for an aerosol spray. Fluorocarbon or hydrocarbon aerosol propellant can also be used.

Preferred formulations are further illustrated by the following examples:

EXAMPLE I

An anti-static spray for use in a pumper-sprayer applicator is prepared according to the following formulation:

| Ingredients | Parts by Wt. |
|---|---|
| Ethanol (denatured) | 93.0 |
| Water (deionized) | 5.0 |
| Fabric Softener (quaternary) | 1.0 |
| Ammonium Acetate | 0.2 |

As indicated by the above formulation, deionized water is preferred. The fabric softener is dimethyl ditallow ammonium chloride. A suitable commerical product is sold under the trademark name "Armosoft M" by Armak Company, Chicago, Ill. Armosoft M is supplied as 65% by weight active ingredient (dimethyl ditallow ammonium chloride). The amount employed will therefore be increased by approximately one-third, that is, to about 1.5 parts by weight in the above formulation. Preferably, the Armosoft M has an Iodine number above 2.8.

Other commercially available fabric softeners which can be substituted for dimethyl ditallow ammonium chloride include the following: docosyl ammonium chloride; docosyl ethyl ammonium bromide; tetrakis-didecyl ammonium methylsulfate; tallowalkyl pentyl dimethyl ammonium chloride; di-hexadecyl dimethyl ammonium chloride; di-octadecyl dimethyl ammonium chloride; di-eicosyl dimethyl ammonium chloride; di-docosyl dimethyl ammonium chloride; di-hexadecyl diethyl ammonium chloride; di-hexadecyl dimethyl ammonium acetate; di-tallowalkyl dimethyl ammonium nitrite; and di-(coconutalkyl) dimethyl ammonium chloride.

EXAMPLE II

Anti-static spray formulations prepared as described in Example I are packaged for aerosol application. A liquid concentrate is first prepared, filled into aerosol containers, and the containers are gassed, either before or after the application of the cap and dispenser assembly. A representative formulation of the liquid concentrate and the packaged product (with propellant) are set out below.

| Ingredients | % Wt. Concentrate | % Wt. Packaged |
|---|---|---|
| Ethanol (denatured) | 93.262 | 88.5989 |
| Water (deionized) | 5.000 | 4.7500 |
| Armosoft (65%) | 1.538 | 1.4611 |
| Ammonium Acetate | 0.200 | 0.1900 |
| Carbon Dioxide | — | 5.0000 |
| | 100.000 | 100.0000 |

A suitable pressure for the carbon dioxide propellant is 100 psig at 70° F. For example, a 9-ounce size aerosol package may be filled with 259 grams of the concentrate and 13 grams of the carbon dioxide propellant.

The spray preparations of Examples I and II are used by applying them directly to clothing or other fabric. For example, in a preferred method of use, the aerosol spray of Example II is applied to clothing until the surface of the clothing feels slightly damp to the touch. After a few minutes, the fabric will feel completely dry, and will be effectively protected against the accumulation of static electricity. In this method of use, it will be understood that the clothing is clean and dry and ready to wear. The anti-static sprays of Examples I and II are not designed to be applied to wet clothing, or used in clothes driers.

EXAMPLE III

As a variation of the anti-static spray composition of Example I, the ingredients are combined in the following amounts:

| Ingredients | Parts by Wt. |
|---|---|
| Ethanol[2] | 98.26 |
| Water[1] | 0.15 |
| Fabric Softener (quaternary)[2] | 1.39 |
| Ammonium Acetate[2] | 0.20 |
| | 100.00 |

[1]Total water.
[2]Anhydrous basis.

The above formulation can be packaged for aerosol application, as described in Example II.

The anti-static sprays of this invention can be applied to the clothing as often as necessary but usually one application lasts until the garment is washed or cleaned. The sprays can be advantageously used on skirts, slips, inside pant legs, on trousers, socks, negligees, etc. In general, the sprays are adapted for use on any clothing evidencing static cling, and are desirably used whenever static cling begins to be evident. It will be understood that the sprays should be applied as evenly as possible.

In addition to the use of the sprays on clothing, they can be applied to other fabrics or fibrous material where the accumulation of static electricity produces clinging, lint attachment, and similar problems. For example, the sprays can be used on drapes and carpeting, or can be applied to the hair of dogs or cats to reduce the build-up of pet hair and lint on furniture and clothing. The sprays can also be used on human hair for removing or preventing static electricity, thereby making it easier to brush, comb, or groom the hair.

We claim:

1. An anti-static spray, comprising: a volatile aqueous ethanol solvent carrier composed essentially of from 2 to 10% by weight water and from 90 to 98% ethanol; and a combination of two anti-static agents dissolved in said carrier, one of said agents comprising a quaternary ammonium fabric softener present in an amount of from 0.5 to 2.0% by weight based on the carrier and the other agent being ammonium acetate, said ammonium acetate being present in an amount of from 0.05 to 0.5 parts by weight per part of said quaternary fabric softener.

2. The anti-static spray of claim 1 in which said ammonium acetate is present in an amount of from 0.1 to 0.3 parts by weight per part of said quaternary fabric softener.

3. An anti-static spray, comprising: a volatile aqueous ethanol solvent carrier composed essentially of from 2 to 10% by weight water and from 90 to 98% ehtanol; and a combination of two anti-static agents dissolved in said carrier, one of said agent comprising 9 quaternary ammonium fabric softener present in an amount of from 0.7 to 1.5% by weight based on the carrier, and the other agent being ammonium acetate, said ammonium acetate being present in an amount of from 0.1 to 0.3 parts by weight per part of said quaternary fabric softener.

4. A method of treating clothing to prevent static electricity from accumulating thereon, said clothing being dry and ready to wear, comprising: applying to said clothing in the form of a spray a volatile aqueous ethanol solvent containing two anti-static agents dissolved therein, said solvent being composed essentially of from 2 to 10% by weight water and from 90 to 98% ethanol, one of said anti-static agents comprising a quaternary ammonium fabric softener present in an amount of from 0.5 to 2.0% by weight based on said solvent, and the other anti-static agent being ammonium acetate, said ammonium acetate being present in an amount of from 0.05 to 0.5 parts by weight per part of said quaternary fabric softener.

5. The method of claim 4 in which said quaternary fabric softener is present in an amount of from 0.7 to 1.5% by weight based on the solvent, and said ammonium acetate present in an amount of from 0.1 to 0.3 parts by weight per part of said fabric softener.

6. An anti-static spray, comprising: a volatile ethanol solvent carrier containing less than 10% water by weight; and a combination of two anti-static agents dissolved in said carrier, one of said agents comprising a quaternary ammonium fabric softener present in an amount of from 0.5 to 2.0% by weight based on the carrier and the other agent being ammonium acetate, said ammonium acetate being present in an amount of from 0.05 to 0.5 parts by weight per part of said quaternary ammonium fabric softener; said spray containing at least 0.1% by weight of water

7. A method of treating clothing to prevent static electricity from accumulating thereon, said clothing being dry and ready to wear, comprising: applying to said clothing in the form of a spray of a volatile ethanol solvent containing two anti-static agents dissolved therein and less than 10% by weight water based on the ethanol, one of said anti-static agents comprising a quaternary ammonium fabric softener present in an amount of from 0.5 to 2.0% by weight based on said solvent, and the other anti-static agent being ammonium acetate, said ammonium acetate being present in an amount of from 0.05 to 0.5 parts by weight per part of said quaternary fabric softener, said spray containing at least 0.1% by weight of water.

* * * * *

UNITED STATES PATENT OFFICE

CERTIFICATE OF CORRECTION

Patent No. 4,129,505 Dated December 12, 1978

Inventor(s) GEORGE F. DASHER and AUGUST E. FIEBIG, JR.

It is certified that error appears in the above-identified patent and that said Letters Patent are hereby corrected as shown below:

Col. 6, line 25 correct the spelling of "ethanol".

Col. 6, line 27 change "9" to --a--.

Col. 6, line 63 add period to end of line (after "water").

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*